United States Patent [19]

Schreiber et al.

[11] Patent Number: 4,760,827

[45] Date of Patent: Aug. 2, 1988

[54] APPARATUS AND METHOD FOR THE IDENTIFICATION OF ANGULAR PULSES

[75] Inventors: Hans Schreiber, Lappersdorf; Marek Molin, Neutraubling, both of Fed. Rep. of Germany

[73] Assignee: Siemens Aktiengesellschaft, Berlin & Munich, Fed. Rep. of Germany

[21] Appl. No.: 934,702

[22] Filed: Nov. 25, 1986

[30] Foreign Application Priority Data

Nov. 25, 1986 [DE] Fed. Rep. of Germany ..... 3541624

[51] Int. Cl.[4] ..... F22D 1/00

[52] U.S. Cl. ..... 123/414; 123/476; 123/490; 324/173

[58] Field of Search ..... 123/476, 490, 478, 487, 123/414, 612, 613, 617, 643; 324/173

[56] References Cited

U.S. PATENT DOCUMENTS 4,121,112 10/1978 Hartig ..... 324/173
4,284,052 8/1981 Hanisko .
4,442,822 4/1984 Kondo et al. ..... 123/414

*Primary Examiner*—Henry A. Bennet
*Attorney, Agent, or Firm*—Hill, Van Santen, Steadman & Simpson

[57] ABSTRACT

A timing arrangement incorporates a timing disk having absolute marks arranged about a circle and serving for the identification of the angular position of the shaft of an internal combustion engine. The marks include a code track havig code marks and absolute marks, each absolute marks being preceded by a code element comprising a number of code marks. Each absolute mark is identified by a code section preceding and consisting of two or more code elements.

7 Claims, 3 Drawing Sheets

P1:-P15
22
21
2
H
C
W
142
14
S
141
122
123
13
13
β2
α
β1
α
α
γ2
γ1
12
12
120, 121
10
11
1

P:14
15
1
2
3
4
5
6
7
8
9
10
11
12
13
α
γ1
γ2
γ3
γ4

APPARATUS AND METHOD FOR THE IDENTIFICATION OF ANGULAR PULSES

BACKGROUND

The invention relates to an apparatus and method for using angular pulses to identify the angular position of a timing disk.

It is necessary, in connection with an electronic fuel injection system, to determined the precise times of points in a cycle where fuel injection events must take place. Such an arrangement is disclosed in U.S. Pat. No. 4,284,052, in connection with a microprocessor which identifies the beginning of the fuel injection and/or ignition cycle. In order to perform its calculation, this control device requires information concerning the current status of the crank shaft which is coupled to the individual cylinders. Accordingly, the crank shaft is coupled to a timing arrangement in the form of a timing disk which has angular marks at the circumference which are read by a pulse generator so as to supply one pulse per mark.

In order to allocate the individual angular marks to a particular point in the cycle, it is necessary to assign a defined shaft position to at least one of the angular pulses, referred to as the absolute pulse. This is done by an additional identifier. To accomplish this, a code element is arranged adjacent each angular mark and the identifier has a number of code marks which are likewise read by a pulse generator to generate code pulses. By this means, each angular pulse is identified by a number of preceding code pulses.

The greatest number of code marks per code element, and thus the length of the largest code element, is defined by the number of angular marks which need to be discriminated. It has been found that an adequate number of angular marks cannot be distinguished on a timing disk having a small diameter and having the standard size teeth.

BRIEF DESCRIPTION OF THE INVENTION

It is a principal object of the present invention to provide an arrangement for developing signals corresponding to particular locations of a timing disk, in which significantly more angular marks are identifiable as absolute marks with a given size and number of code marks.

In one embodiment of the present invention, each angular mark to be identified as an absolute mark is assigned a code sector composed of two or more code elements, the angles of which are identical to the sector angles of the sector elements adjacent an absolute mark, whereby the angles of the code elements are arranged in the same sequence as the sector angles of the sector elements. It is thus possible to distinguish the number of code pulses associated with the individual code elements, with the assistance of the angular marks and absolute marks. A number of absolute marks equal to $T^E-1$ can be distinguished with a basic set T of different code elements, where E is the element count. Inversely, a basic set of T different code elements which is equal to the logarithm of the overall mark number $M+1$ belongs to a set of M absolute marks, so that the logarithm is equal to the element count E belonging to every code sector.

When, for example, two code elements ($E=2$) are selected per code sector, then a basic set T of four different numbers of code elements is required for an overall absolute mark number $M=15$. Accordingly, the code elements may have 0, 1, 2, 3 code marks, or 1, 2, 3, 4 code marks, etc. In these instances, however, all permutations of four different code elements must be exploited, so that the combination of the two longest code elements must also be exploited. If it is assumed in the simplest case that all code marks describe the same fundamental angle $\alpha$, in an equidistant arrangement, then the overall length of the greatest code sector thereof is equal to $2\times5\ \alpha$.

A more favorable exploitation of the space on the timing disk can be achieved in accordance with a development of the invention, given the same overall mark count M, when one employs an overall set A of fundamental quantities which is greater than the previously calculated fundamental set T. In this case, optimally short combinations can be selected from the overall number of different combination possibilities of code elements in order to form the code sectors. Moreover, the latitude of design for the distribution of the angular marks over the circumference of the timing disk is increased considerably. Further, the size of the dead angle per code sector decreases with the number of angular marks.

Fundamentally, the individual code marks can be arbitrarily arranged in the code elements. Preferably, however, all code marks form a code track in which the code marks are separated by the same fundamental angle $\alpha$. This allows the individual angles of the code elements, and the overall angle of the code sectors, to be large enough so that they can be integrally divided by the fundamental angle.

The main track with the angle marks and absolute marks, and the code track having the code marks as well as the allocated code sectors, can be arranged such that the angular pulses separating the code pulses of neighboring code elements lie between two code pulses. In an especially simple embodiment of the invention, the arrangement is selected such that every angular pulse coincides with a code pulse.

As in the prior art, the code track can lie on a separate code disk coupled to the timing disk, preferably rotating synchronously therewith. The code track, however, can be arranged on the timing disk itself next to the main track. Accordingly, a code sensor for the code track can also be integrated into the same housing with the sensor for the main track.

In a known way, sensors can be employed which function optically, mangetically, or inductively, in cooperation with the corresponding code marks. Teeth at the circumference of a metal disk have proven particularly useful as code marks and/or angular marks, such teeth being relatively sensed with an inductively operating sensor.

An especially advantageous embodiment of the invention is realized in combination with the Hartig pulse generator described in U.S. Pat. No. 4,121,112. This operates with a timing disk having teeth of ordinary iron arranged equidistantly at its circumference, with such teeth having relatively high eddy current losses. The teeth intended to function as absolute mark teeth have significantly lower eddy current losses. For example, they comprise a slot oriented at a right angle relative to the rotational direction, which slot is filled with a material having higher permeability than the material of which the other teeth are formed. The sensor evaluates the ratio of magnetic permeability to the electrical conductivity of each tooth. This ratio differs significantly in slotted and unslotted teeth. As a result, the sensor supplies a pulse per tooth, however, the angular pulse caused by a slotted tooth has a significantly greater amplitude, which function is independent of the speed of rotation of the disk.

In combination with a four-cycle engine, such a timing disk is preferably arranged on the cam shaft rotating with half the speed of the crank shaft. However, it is also possible to connect the timing disk directly to the crank shaft, and also to employ an auxilliary signal generator on the cam shaft. The latter has to supply an output signal (such as a high or H-signal) only during a first revolution, with a low or L-signal during the following revolutions. An unambiguous distribution of the pulses of the timing disk to the individual cylinders is thus possible with such a signal. In addition, the code pulses can be employed for the identification of the speed of rotation of the engine.

In a further modification of the invention, the main track having the angular marks and absolute marks can also be arranged on a timing disk connected to the cam shaft, and the code track having the code marks can be arranged on a coding disk connected to the crank shaft.

BRIEF DESCRIPTION OF THE DRAWINGS

Reference will not be made to the accompanying drawings in which.

DESCRIPTION OF THE PREFERRED EMBODIMENT

Figure 1:
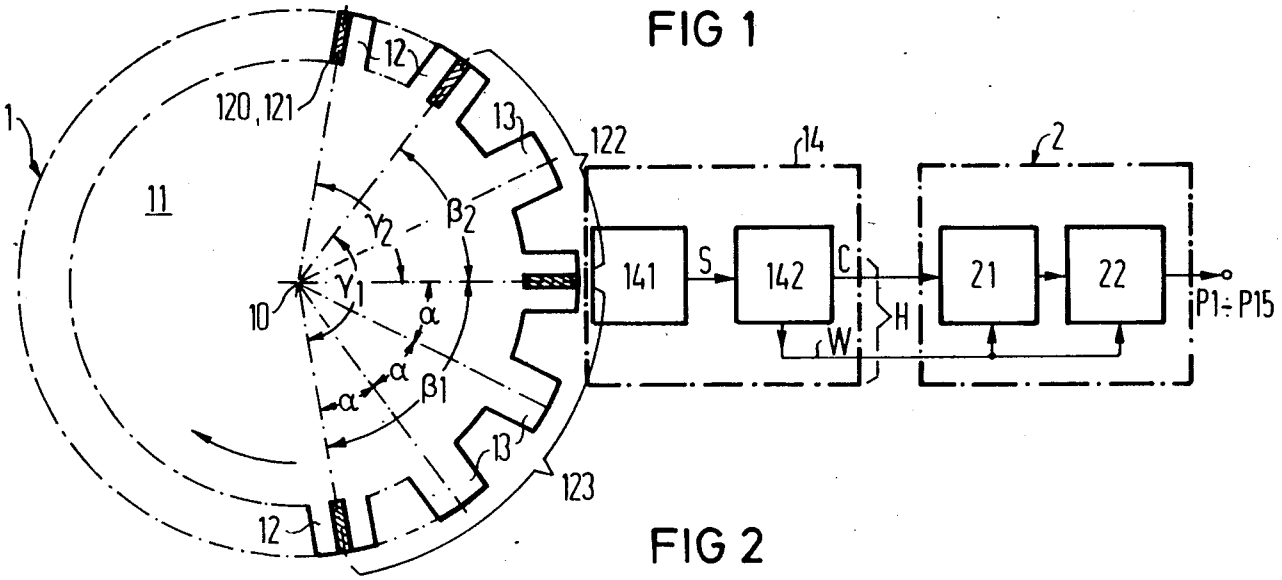
FIG. 1 is a diagrammatic illustration of the fundamental structure of an illustrative embodiment of the present invention.

Referring now to FIG. 1, a circular disk 11 is formed of ordinary iron and is connected for rotation with shaft 10 which is coupled with a cam shaft of an internal combustion engine. The disk has 54 teeth 12, 13, which are equidistantly arranged at the circumference of the disk, with the individual teeth 12 having transverse slots 120 which are filled with a material having a higher permeability than the iron of which the remainder of the disk is formed. These teeth have the function of identifying an absolute mark 121 and are referred to as mark teeth 12. The distance between adjacent teeth, from center to center, is defined by a fundamental angle $\alpha$ which amounts to 6° 40 minutes, given 54 equally spaced teeth.

Two successive absolute marks 121 identify a sector element 122, 123 having a sector angle $\beta 1$ or, respectively, $\beta 2$. Every sector element corresponds with a code element of the same size so that the code angle is equal to the sector angle. Two successive code elements (element count E=2) respectively form a code sector having an overall angle $\gamma 1$ or $\gamma 2$, respectively. A code sector comprising the two preceding absolute marks and code elements thus belongs to every absolute mark 121. Every code element angle $\beta$, code angle and overall sector angle $\gamma$ is integrally divisible by the fundamental angle $\alpha$ without remainder.

Figure 2:
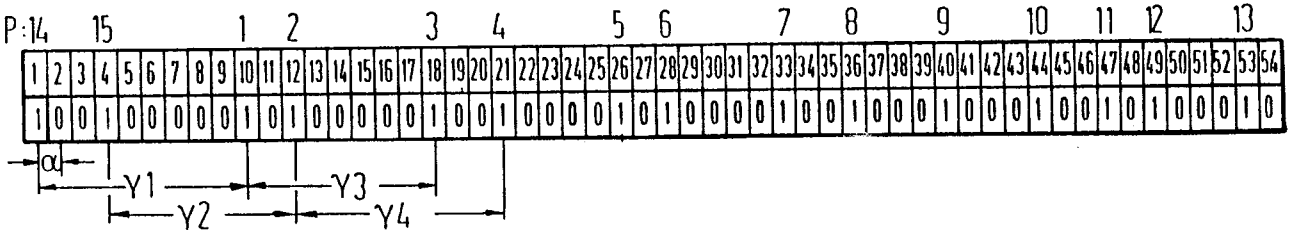
FIG. 2 is a diagrammatic representation showing the distribution of angular marks and code marks on the teeth.

The distribution of the code sector over the circumference of the timing disk is determined by the application in which the invention is employed. Hereinafter, the invention will be described in connection with a 6 cylinder engine. Referring to FIG. 2, a chart illustrates the 54 teeth of the disk 11, which are identified by number in the second line. In the third line, a "1" indicates a mark tooth 12 having an absolute mark 121, and a "0" indicates a simple tooth 13 serving as code mark or a code tooth 13. In the first line, identified with a P, the number of 15 discrete pulses (P1 through P15) is indicated above the individual mark teeth 12.

For code sectors, each having two successive code elements comprising an overall angle of $\gamma 1$ through $\gamma 4$ are indicated in the fourth and fifth lines of FIG. 2. In the sequence of code elements illustrated in FIG. 2, five different sets of code teeth are provided having 1, 2, 3, 4 or 5 successive code teeth.

The timing disk 11 has a pulse generator 14 associated with it which contains a sensor 141 and a discriminator 142. The sensor 141 senses the teeth of the timing disk 11 and evaluates the ratio of electrical conductivity to magnetic permeability of the teeth, as described in U.S. Pat. No. 4,121,112. The sensor supplies an output signal S (illustrated in the top line of FIG. 4) in the form of one angular pulse per tooth, with the angular pulse produced by the mark tooth 12 having a significantly greater amplitude than the code pulses produced by the ordinary code teeth 13. A discriminator 142 is connected to receive the signal S and discriminates between these two amplitudes and supplies two outputs C and W corresponding to code teeth and mark teeth, respectively. The outputs C and W both represent a timing signal H. Both components of the timing signal H are supplied to a decoder 2 having an element decoder 21 and a sector decoder 22 and which supplies absolute pulses to different decoder outputs P1 through P15 allocated to the individual absolute marks.

The basic operation of the coding arrangement of FIG. 2 will be explained with reference to the least favorable case, that is, when the beginning of rotational movement of the timing disk 11 finds the sensor 141 in the gap betwen the mark tooth 12 and the following code tooth 13, namely, at the beginning of the longest code element ($6\alpha$). As soon as tooth 18 having the following absolute mark passes the sensor 141, the mark pulse produced thereby starts a counter in the decoder 2 which counts the number of code pulses between this absolute mark and the following absolute mark, allocated to the tooth 21. This value ($3\alpha$) is stored at the time of the following angular pulse. With further rotation of the timing disk, the following code pulses of the teeth 22 through 25 are counted and this value ($5\alpha$) is likewise stored at the time of the angular pulse of the mark tooth 26. The decoder then forms an absolute pulse from these two stored values and supplies it to a decoder output P allocated to the mark tooth 26, namely, P5. In this least favorably case, the shaft 10 must turn through a dead angle of 93° and 20 minutes (equal to $14\alpha$) before the first absolute pulse P5 is produced. However, at this time, an unambiguous allocation of the first injection and/or ignition pulse to the correct cylinder is made possible. Above all, a sequential injection can be realized, which positively avoides an injection in the exhaust cycle of a cylinder for example.

Figure 3:
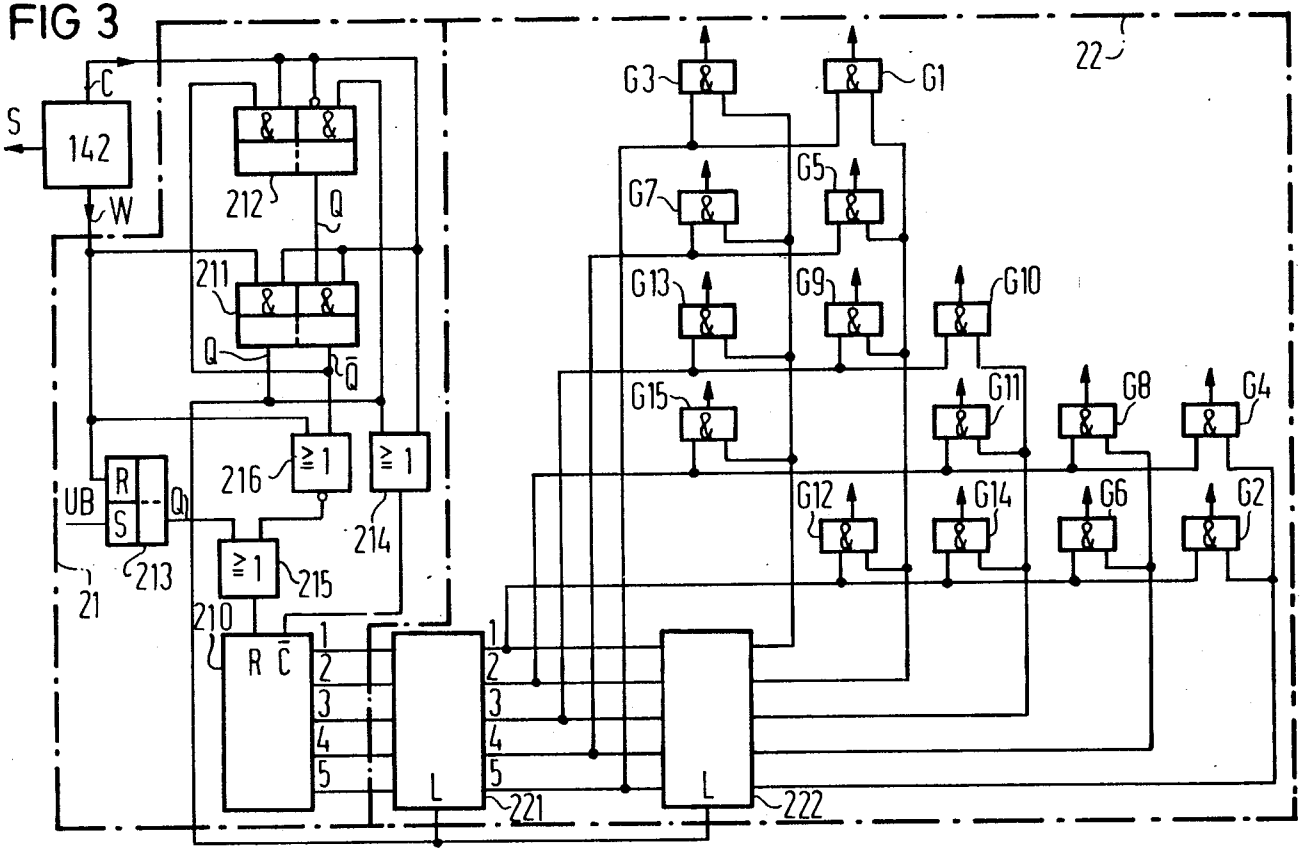
FIG. 3 is a functional block diagram illustrating an exemplary embodiment of the decoder.
Figure 4:
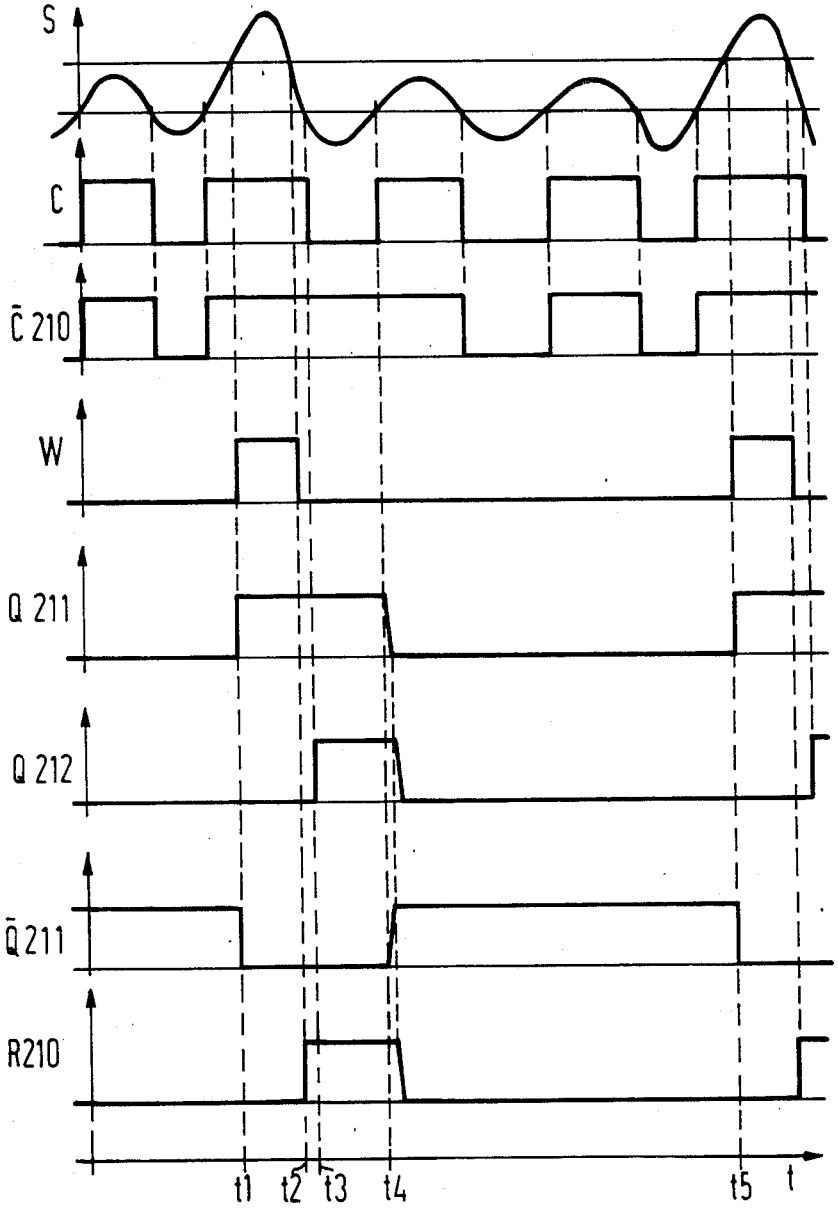
FIG. 4 is a series of pulse diagrams serving to illustrate operation of the apparatus of FIG. 3.

An exemplary embodiment of the decoder 2 is illustrated in FIG. 3, which also illustrates the discriminator 142 of the pulse generator 14 to facilitate understanding of the manner in which it is connected. The element decoder 21 is connected to receive the C and W pulses, and is essentially composed of a decoding counter 210 having 5 data outputs, corresponding to the maximum number of code teeth per code element. The counter is incremented by the negative going edge of a counting signal $\overline{C}$ 210 (FIG. 4). The output of the counter supplies a signal representing the number of code marks per code element in the form of a high level on one of the five data outputs of the counter, with low signals present at the remaining outputs. The counter receives a reset or a clear signal R 210 via an input R.

For the formation of the count signal $\overline{C}$ 210, the code pulses C and the angular pulses W are edited, with the assistance of two RS flip-flops 211, 212 whose set and reset inputs are each supplied by the output of individual NAND gates. The RS flip-flops are constructed in the known way, by cross coupling inputs and outputs of a pair of NOR gates.

The Q and $\overline{Q}$ outputs of the flip-flop 211 are shown in FIG. 4 as Q 211 and $\overline{Q}$ 211, respectively. The output of the flip-flop 212 is shown as Q 212.

In the present embodiment, two latch elements 221 and 222 are provided, which are connected to each other and to the counter 210. The inputs of the latch 221 are connected to corresponding outputs of the counter 210, and the output of the counter is latched or stored in the latch 221 with the rising edge of a clock signal Q 211 which is applied to the input L of the latch 221. This stored value is then made available at the outputs of the latch 221 beginning with the negative going edge of the clock signal. The inputs of the latch 222 are connected to the output of the latch 221 and operates in corresponding fashion, to store the signal presented to its inputs at the time of the positive going signal applied to the input terminal L. In this way, the output of the counter 210 representing the state of the counter, is stored successively in the latches 221 and 222, which together manifest the state of the counter 210 at the two preceding clock pulses applied to the terminals L.

The outputs of the two latch elements 221 and 222 are connected to a matrix of AND gates G1 through G15, which functions as a decoder to decode the output signals P1–P15 in accordance with discrete combinations of the outputs presented by the latches 221 and 222. In this way, an absolute pulse P1–P15 is supplied at the end of each clock signal, which is clearly allocated to a particular absolute mark 121.

The inputs and outputs of the flip-flops 211, 212 of the element decoder 21 are directly combined with each other, and with the outputs of the counter 210 in the illustrated way, by way of OR gates 214 and 215 and a NOR gate 216. This combination generates the clock signal Q 211 (FIG. 4), with the appearance of every angular pulse W, and with the subsequent generation of a reset signal R 210 which resets the counter 210.

During start-up, since only a complete code element should be evaluated, an RS flip-flop 213 supplies a reset pulse for the counter 210 at its output Q in response to a setting input $U_B$ which identifies the start-up time. This is connected to the reset input of the counter 210 through the OR gate 215. This signal is maintained until the time of the first angular pulse W which is applied to the reset input of the flip-flop 213, terminating its Q output. Because of the high level on its reset input, the counter 210 does not count code pulses C until after the first angular pulse W. The clock signal Q 211 is then formed coincident with the following angular pulse at time t1 as shown in FIG. 4. And the clock signal Q 211 is supplied to the latch inputs L of the latch units 221 and 222.

With the end of the angular pulse W at time t2, the counter 210 is reset by a reset signal supplied by the NOR gate 216 when neither an angular pulse W is present, nor is there a $\overline{Q}$ output from the flip-flop 211.

The negative going edge of a code pulse C which coincides with an angular pulse W should not be counted, and this is achieved by maintaining the output of the OR gate 214 high until the positive going edge of the following code pulse C, occuring at time t4 (FIG. 4).

This status of the flip-flops 211 and 212 is preserved until time t5, the time of the next angular pulse W. In the meantime, the counter 210 is enabled and counts the negative signal edges of the count signal $\overline{C}$ 210. At time t5, only that output of the counter 210 corresponding to the number of code pulses in the preceding code element then has a high level and the clock signal Q 211 is then generated with the leading edge of the angular pulse, so that the state of the counter 210 is stored in the first latch element 221, and the previously stored data in the first latch is accepted by the second latch element 222. With the trailing edge of the angular pulse, the counter 210 is again reset, in order to acquire the number of code pulses of the following code element. During this period, the gate array G1–G15 decodes the appropriate output pulse P1–P15.

The latch element 221 always indicates the number of code pulses in the first code element at its output, and the latch element 222 indicates the number of code pulses in the second code element for every code sector. The combination of these two numbers changes after every code element, and is therefore a reliable identifier for every code sector, and for the absolute mark associated with it.

It will be appreciated from the foregoing that the present invention furnishes a simple and reliable method and apparatus for identifying without ambiguity particular locations on the timing disk. It is apparent that various modifications and additions in the present invention may be made without departing from the essential feature of novelty thereof which are intended to be defined and secured by the appended claims.

What is claimed is:

1. Apparatus for the identification of angular pulses comprising in combination;

timing means including a disk coupled to a shaft of an internal combustion engine, said timing disk having a plurality of angular marks distributed about the periphery of said timing disk at intervals defined by code element angles, a plurality of code sectors distributed about the periphery of said timing disk at intervals defined by a plurality of consecutive code elements, said code elements being of variable length with at least some of said code elements containing one or more code marks, each of said code sectors having a unique combination of code marks within its code elements, a pulse generator juxtaposed with said timing disk for sensing said angular marks and for producing pulses in response to said angular marks and said code marks, a decoder connected to said pulse generator, said decoder containing a counter for counting code pulses occurring between two successive angular marks, and means connected to said counter for producing one of a plurality of signals at the end of every code element to identify an angular mark.

2. Apparatus for identifying an annular mark as an absolute mark comprising;

a disk adapted to be rotated by an internal combustion engine, said disk having a plurality of angular marks irregularly distributed about its periphery, said angular marks separating said disk into plural code elements of different size, extending between adjacent angular marks, at least some of said angular marks being separated by one or more code marks to define the length of said code elements, each plurality of adjacent code elements defining a code sector which is uniquely identified by the sizes of said plurality of adjacent code elements, sensor means for detecting said angular marks and said code marks as said disk rotates, and means connected to said sensor means and responsive thereto for manifesting signals corresponding to consecutive absolute marks as said disk is rotated.

3. Apparatus according to claim 1, wherein each angular mark has its own code sector on said timing disk, and all code sectors have the same number of code elements, said code elements containing different combinations of code marks.

4. Apparatus according to claim 3, wherein a total set (A) of different code elements is provided equal to or greater than the logarithm of the overall number of angular marks plus one (M+1), to form a basis which is equal to the number (E) of code elements associated with each code sector.

5. Apparatus according to claim 4, including a code sensor for said pulse generator for sensing each code mark, and a main sensor for sensing the angular marks on said timing disk.

6. Apparatus according to claim 4, wherein said timing disk has a plurality of teeth composed of ferro magnetic material of identical width and arranged equidistantly about its circumference as code marks, individual ones of said teeth serving as angular marks and having lower eddy current losses than the remaining teeth, and wherein said pulse generator comprises a single sensor evaluating the ratio of magnetic permeability to electrical conductivity for each tooth, and supplies, as output signals, a first series of signals with one pulse per tooth, and a second series of signals with one pulse per angular mark tooth, said second series of signals having a significantly greater amplitude than said first series of signals, and including a discriminator responsive to said first and second series signals for separating said first series of signals from said second series of signals.

7. Apparatus according to claim 4, wherein said decoder contains an element decoder and a segment decoder, said element decoder comprising a counter for counting code marks between two successive angular marks, a plurality of latch elements connected to said counter for storing the state of said counter corresponding to successive angular marks, and means connected to the outputs of said latch elements for generating one of a plurality of absolute pulses corresponding to the individual states of said latches following the occurance of each angular mark.

* * * * *